United States Patent [19]

Seregely

[11] 4,308,849

[45] Jan. 5, 1982

[54] PROJECTILE LAUNCHER

[76] Inventor: Daniel Seregely, P.O. Box 2021, Santa Monica, Calif. 90406

[21] Appl. No.: 148,702

[22] Filed: May 12, 1980

[51] Int. Cl.[3] ..... F41B 3/04

[52] U.S. Cl. ..... 124/5; 273/416; 46/81; 124/41 R

[58] Field of Search ..... 124/5, 41 R, 6, 7, 8, 124/79

[56] References Cited

U.S. PATENT DOCUMENTS

| | | | |
|---|---|---|---|
| 1,186,098 | 6/1916 | Horst | 124/5 |
| 3,373,730 | 3/1968 | Jenison | 124/5 |
| 3,901,208 | 8/1975 | Laporte et al. | 124/5 |

*Primary Examiner*—Richard C. Pinkham

*Assistant Examiner*—William R. Browne

*Attorney, Agent, or Firm*—Poms, Smith, Lande & Rose

[57] ABSTRACT

A projectile launcher for launching toy airplanes, darts, and the like. An elongated rigid member has a handle portion on one end and has a resiliently flexible member extending from the handle in close adjacent parallel relationship to the rigid member. At the end opposite the handle, the rigid member has a forward projection directed towards the flexibly resilient member to form a pocket between the two. The projectile or a weighted portion thereof is inserted within the pocket. When the launcher is swung by the handle, the pocket is maintained closed by the pushing force of the rigid member. Upon reaching the end of the launching stroke, the flexible member continues its motion by flexing to thereby open the pocket and release the projectile.

4 Claims, 12 Drawing Figures

PROJECTILE LAUNCHER

BACKGROUND OF THE INVENTION

The present invention relates to projectile launchers and, more particularly, to hand-held launchers for the launching of small articles such as toy airplanes, darts, and the like.

Hand-held projectile launchers are probably one of the oldest inventions known in the art. The cavemen used throwing sticks as an extension of the arm for throwing spears with greater force and accuracy than was possible with the naked arm. Thus, the advantages of an elongated member for throwing as an extension of the arm are well-known. While the advantages of such arm extenders are well-known, to-date their benefits have been applied to limited applications. For example, in the throwing of a spear, the arm extender has a notch, or the like, on the free-end into which the end or a mating notch of the spear is inserted to act in the manner of a cupped hand to hold and project the spear. A catapult acts in the same manner wherein the object to be thrown is placed in an open basket, platform, or the like, and upon the catapult being released, the projectile is lifted and pushed forward towards the target.

Two factors emerge from these prior art launching devices. First, the centrifugal force is not utilized. Second, such a device has not been available for smaller projectiles such as toy airplanes, darts, and the like. Typically, such smaller projectiles are launched with a spring or rubber band-type launcher wherein the rubber band is stretched in the direction opposite of the projectile's intended direction with the projectile on that end and releasably attached thereto while the opposite end of the rubber band or spring is held in the hand or otherwise.

Wherefore, it is the object of the present invention to provide a hand-held projectile launcher for such projectiles as toy airplanes, darts and the like which employs the principle of arm extension and utilizes centrifugal force as the primary propelling force.

SUMMARY

The foregoing objective has been met by the projectile launcher of the present invention comprising an elongated rigid member having a handle portion on one end adapted for gripping and an outward projection normal to the longitudinal axis of the member adjacent the opposite end thereof; and, a resiliently flexible member connected to the rigid member adjacent the handle portion on one end to be disposed close adjacent and parallel to the rigid member, said flexible member covering and resting against the outer end of the projection on the other end to form a pocket between the projection, the flexible member and the rigid member adjacent the projection wherein a projectile can be placed in the pocket and launched by rapidly swinging the launcher in the direction of the projection to a point of release wherein the swinging is terminated to, thereby, open the pocket and release the projectile.

DESCRIPTION OF THE PREFERRED EMBODIMENT

Figure 1:
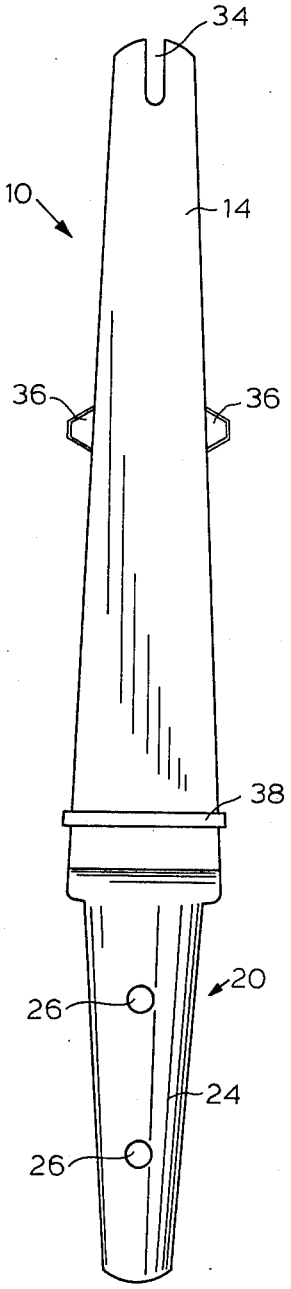
FIG. 1 is a front elevation of the preferred embodiment of the present invention adapted to launch a number of different kinds of projectiles.
Figure 2:
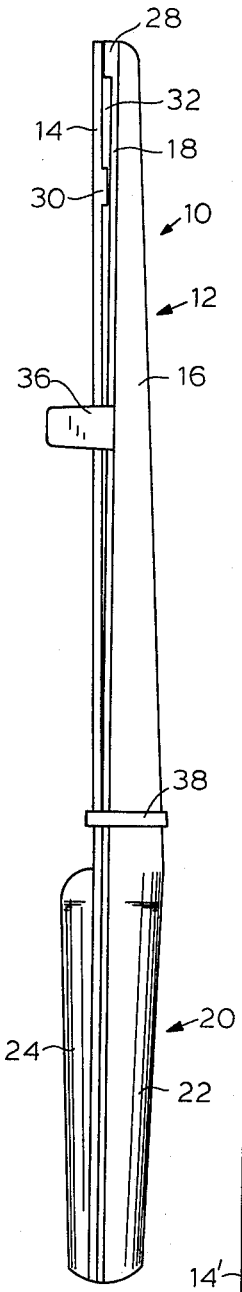
FIG. 2 is a side elevation of the launcher of FIG. 1.

Turning first to FIGS. 1 and 2, the launcher, generally indicated as 10, of the present invention is shown. In its preferred embodiment, launcher 10 comprises an elongated rigid member generally indicated as 12, and an elongated resiliently flexible member, generally indicated as 14. In a tested embodiment, the resiliently flexible portion of the launcher 10 to be described in greater fetail hereinafter were constructed of flat polyethylene plastic strips. Any other plastic material or, for that matter, even thin metal could be employed. Likewise, while the required rigidity to be described was accomplished by the use of wood, thicker plastic or metal (solid or hollow) imparting the characteristics to be described hereinafter could be employed.

In the preferred embodiment, elongated rigid member 12 actually comprises a rigid piece 16 with a resiliently flexible piece 18 disposed adjacent thereto. While this construction is preferred, it will be seen from discussions hereinafter that elongated rigid member 12 could comprise a single rigid piece. Launcher 10 has a handle, generally indicated as 20, disposed on one end for gripping by the hand. As a matter of convenience and construction, launcher 10 can be assembled and handle 20 provided by forming half of handle 20 from the lower portion 22 of rigid piece 16 and sandwiching the elongated resiliently flexible member 14 and resiliently flexible piece 18 between lower portion 22 and a separate handle front portion 24 to be held in place as with rivets 26. The resiliently flexible piece 18 has a projection 28 normal to the longitudinal axis of the launcher 10 facing towards the elongated resiliently flexible member 14. Elongated resiliently flexible member 14 has a projection 30 disposed towards the handle 20 from projection 28 and facing towards resiliently flexible piece 18. Both projections 28 and 30 are of substantially equal length in the direction of projection and project only a short distance. For example, in a tested embodiment wherein the launcher was of approximately one foot in length, elongated resiliently flexible member 14 was made of ⅛ inch thick polyethylene and both projections 28 and 30 were likewise, ⅛ inch thick. By such construction, both elongated resiliently flexible member 14 and resiliently flexible piece 18 lie parallel to and close adjacent the rigid piece 16 and are free to flex. Being generally resilient in nature, both elongated resiliently flexible member 14 and resiliently flexible piece 18 tend to lie close adjacent rigid piece 16, as shown, from the self-bias of the plastic material. Projections 28 and 30 tend to force member 14 and piece 18 apart to form a pocket 32 bounded by member 14, piece 18, and projections 28, 30.

For particular applications to be described in greater detail hereinafter, both engated rigid member 12 and elongated resiliently flexible member 14 have a coincident slot 34 therein extending from the end of launcher 10 towards the handle 20 past projection 28 to, thereby, communicate with the pocket 32. Likewise, for another particular application, a pair of projections 36 extend from a position on resiliently flexible piece 18 between pocket 32 and handle 20. One of the projections 36 is on each side of resiliently flexible piece 18 and the projections 36 face generally in the same direction as projection 28.

To provide adjustability relative to the weight of projectiles being employed, it is convenient to place a heavy rubber band, such as that indicated as 38, about both elongated rigid member 12 and elongated resiliently flexible member 14. By positioning rubber band 38 along the length thereof, the point of flexure of the flexible portions of launcher 10 and, thereby, the tension tending to hold the pocket 32 closed can be adjusted. While rubber band 38 is a simple and convenient method to be employed, other methods of changing the effective flexible length of elongated resiliently flexible member 14 can, obviously, be employed.

Figure 3:
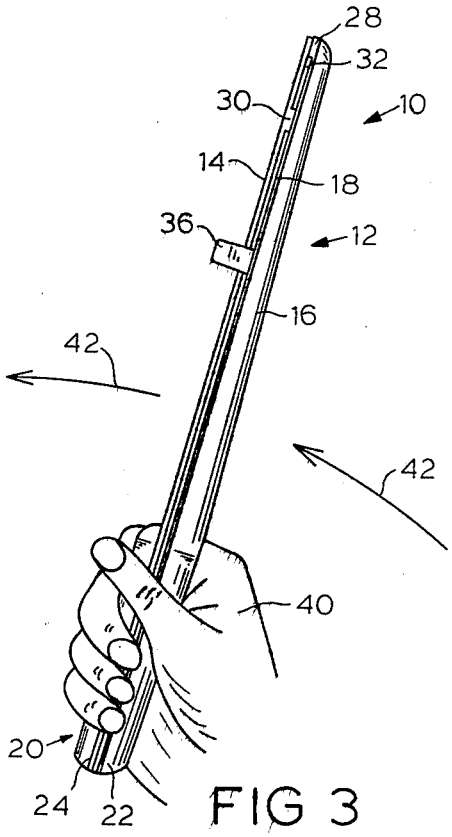
FIG. 3 is a drawing showing the method of swinging the launcher of FIGS. 1 and 2 to launch a projectile.
Figure 4:
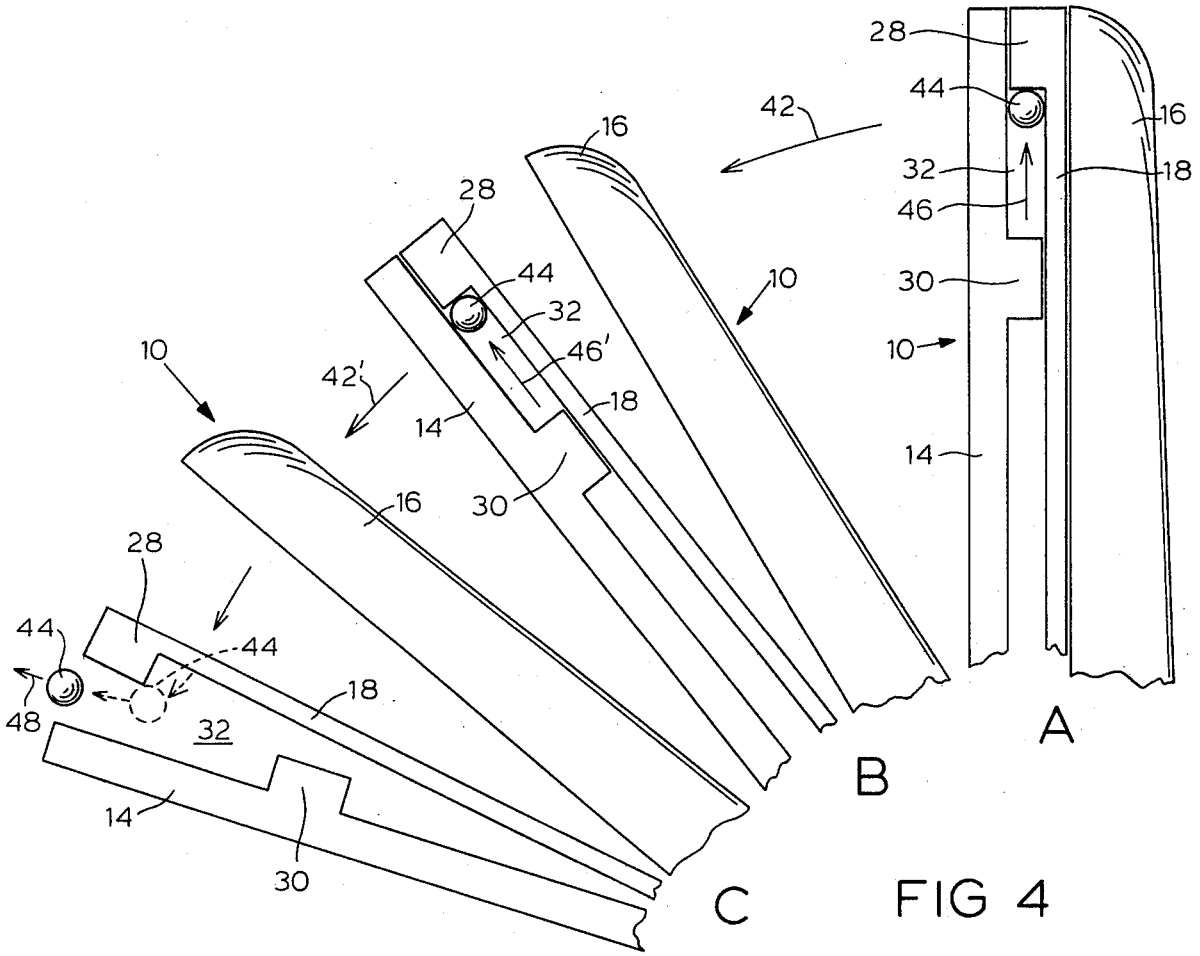
FIG. 4 is a detailed side view of the launcher of FIGS. 1-3 showing the method of operation thereof in holding a projectile within the pocket and launching the projectile as a result of centrifugal force.

Turning now to FIG. 3, launcher 10 is shown in its method of use for launching. For simplicity, no projectile is shown therewith in FIG. 3. For launching, launcher 10 is held in the hand 40 and swung rapidly in a snapping motion as indicated by the arrows 42 in much the same manner ms one would snap or crack a whip. That is, launcher 10 is swung rapidly in the general direction of the target area and then quickly brought to a stop. The effect of this is shown in detail in FIG. 4. As can be seen in FIG. 4A, as launcher 10 is swung in the direction of arrow 42, a projectile 44 contained within pocket 32 is forced outwardly by centrifugal force as indicated by the arrow 46. In prior art arm extending-type throwers, it is the force against the projectile 44 in the direction of arrow 42 which is the ultimate propelling force. If the centrifugal force became excessive, the projectile was lost prior to release in the desired directions. In the present invention, as can be seen, a very high centrifugal force can be imparted against the projectile 44 since it is trapped within the pocket 32. As the launcher 10 is stopped in its forward travel by the snapping action imparted thereto in the launching procedure is described above, launcher 10 first assumes the position shown in FIG. 4B. That is, the rigid piece 16 is stopped (or may, in fact, begin to move in the direction opposite arrow 42) while elongated resiliently flexible member 14 and resiliently flexible piece 18 continue to move forward in the direction of arrow 42' because of the inertia imparted thereto. At this point, centrifugal force, as indicated by the arrow 46', continues to force the projectile 44 outwardly within the containment of pocket 32.

The projectile 44, however, has an inertia of its own having a component normal to elongated resiliently flexible member 14. This causes launcher 10 to assume the position shown in FIG. 4C. That is, projectile 44 forces elongated resiliently flexible member 14 away from resiliently flexible piece 18 to open pocket 32 whereupon projectile 44 moves from within the pocket 32 (as shown by the ghosted position and arrows) to emerge therefrom along its line of trajectory, as indicated by the arrow 48, under the force of the centrifugal force imparted thereto.

Figure 5:
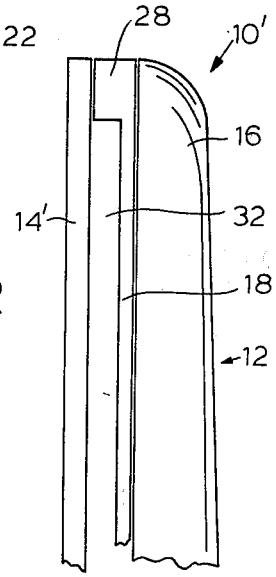
FIG. 5 is an end view of an alternate embodiment of the present invention.
Figure 6:
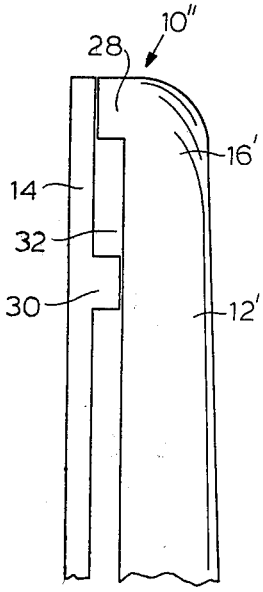
FIG. 6 is a side view of yet another alternate embodiment of the launcher of the present invention.

Turning briefly to FIGS. 5 and 6, two alternate embodiments for constructing the launcher of the present invention are shown. In the embodiment of FIG. 5, launcher 10' incorporates in elongated resiliently flexible member 14' not having projection 30 thereon. Thus, there is no bottom to the pocket 32 and pocket 32 comprises the entire area between projection 28 and handle 20 bounded on either side by elongated resiliently flexible member 14' and resiliently flexible piece 18. Likewise, as shown in FIG. 6, a launcher 10'' is shown wherein elongated rigid member 12 comprises a single rigid piece 16' having projection 28 as part thereof. That is, resiliently flexible piece 18 is omitted. It will be understood than another embodiment (not shown) could be constructed employing rigid piece 16' from FIG. 6 in combination with elongated resiliently flexible member 14' from FIG. 5.

From the foregoing discussion, it will be understood that the launcher 10, as described above, can be used to launch numerous projectiles placed within the pocket 32 thereof. The slots 34 play no part in the launching of such projectiles.

Figure 7:
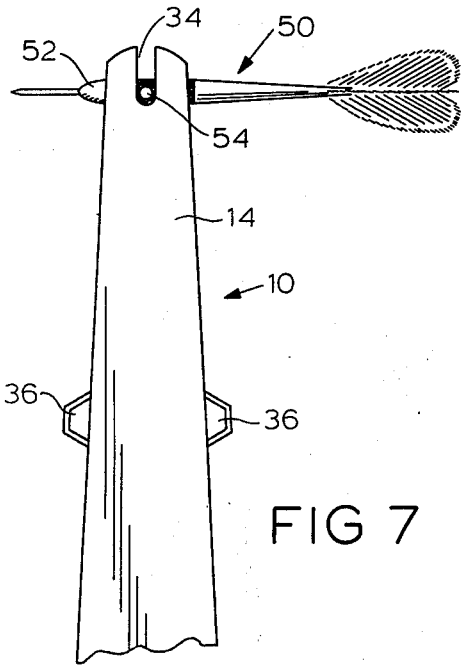
FIG. 7 is a drawing of the launcher of the present invention holding a dart ready for launching.
Figure 8:
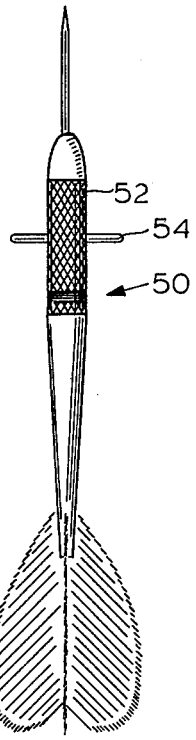
FIG. 8 is a drawing of a dart in its preferred embodiment for use with the present invention.
Figure 9:
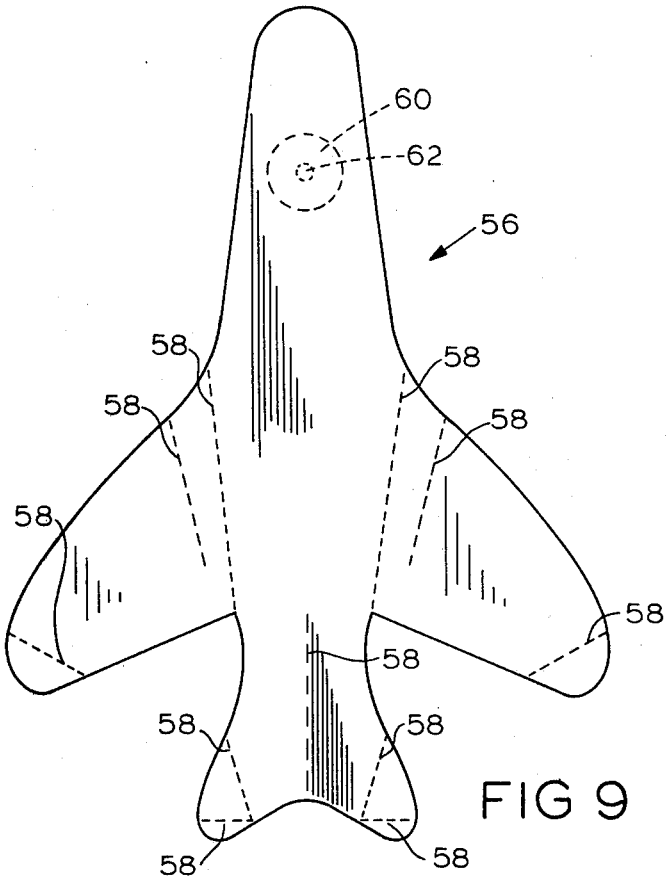
FIG. 9 is an elevation view of a toy airplane particularly adapted for use with the present invention.

Turning now to FIGS. 7 and 8, the launcher 10 of the present invention is shown as employed in launching or throwing a dart 50. While a standard dart could be employed and slot 34 not used, it is preferred that, as shown in FIG. 8, standard dart 50 be modified by drilling the body 52 thereof at the approximate center of gravity thereof in a transverse direction and forcibly inserting pin 54 therethrough as shown. With or without the pin 54, the dart is placed in a sideward or lateral configuration with the body 52 within pocket 32 as shown in FIG. 7 for launching. To prevent inadvertent twisting and mislaunching, the center of gravity of the dart 50 should be placed substantially along the longitudinal axis of launcher 10. By having pin 54 and slot 34 and placing pin 54 within slot 34 as shown in FIG. 7, this condition is automatically achieved. Dart 50 is launched in the exactly same manner as described above with respect to the projectile 44 and turns to be pointed in the direction of flight after launching because of its inherent aerodynamics.

Figure 10:
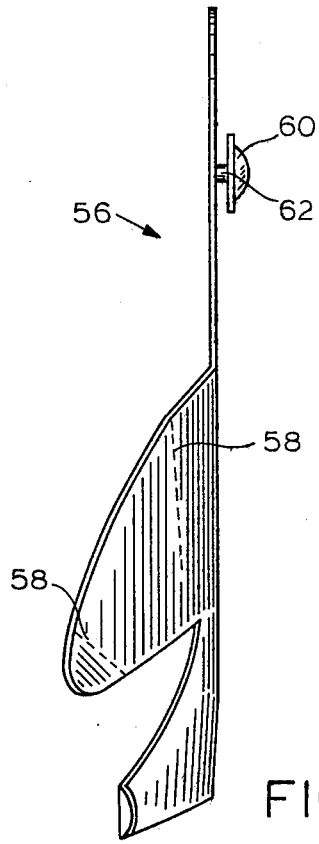
FIG. 10 is a side view of the toy airplane of FIG. 9.
Figure 11:
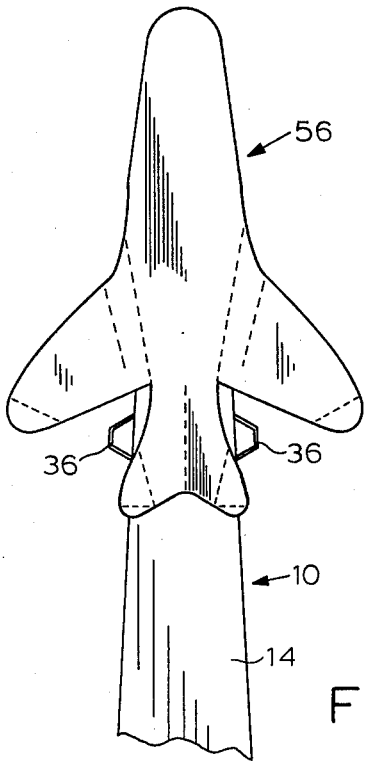
FIG. 11 is a drawing of the airplane of FIGS. 9 and 10 mounted on the launcher of the present invention.

Turning now to FIGS. 9 through 12, a toy airplane particularly adapted for use with the launcher of the present invention is shown. As particularly shown in FIGS. 9 and 10, plane 56 comprises mainly a sheet of highly resilient flexible plastic having living-hinges 58 formed therein. Living-hinges and the methods of the creation thereof in plastic materials are well-known to those skilled in the art and, per se, form no part of the present invention. By bending the living-hinges 58, the plane 56 can be bent conveniently into a configuration as shown in the side of FIG. 10 which imparts flight characteristics thereto. The various bending can be modified, as desired, to change the flight characteristics of plane 56.

Figure 12:
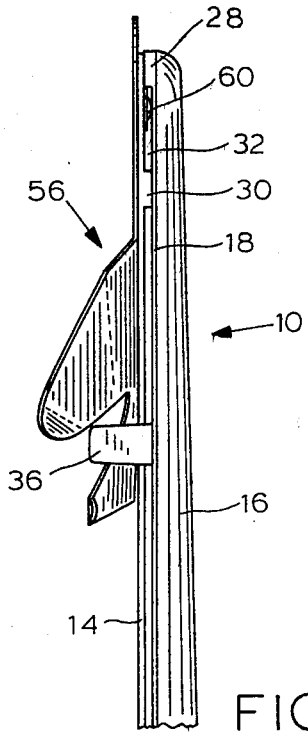
FIG. 12 is a side view of the plane and launcher of FIG. 11.

As discussed above, the launcher 10 of the present invention is adapted to, basically, launch a weighted projectile placed within pocket 32. Conveniently, toy airplanes require a weight adjacent the nose portion in order to fly. In plane 56 adapted to be launched by the launcher 10 of the present invention, the weight 60 is mounted on an extension shaft 62 below the nose of the airplane 56. As best seen in FIG. 12, to mount the plane 56 to the launcher 10 for launching, the extension shaft 62 is disposed within the notch 34 and the weight 60 is disposed within the pocket 32. The extension shaft 62 should be just slightly longer than the thickness of elongated resiliently flexible member 14 such that the lower surface of the plane 56 is close adjacent the outer surface of elongated resiliently flexible member 14. Likewise, the weight 60 is conveniently shaped as a generally disc-shaped member such that it provides no drag on the airplane and fits within the pocket 32 as shown. The tail of the plane 56 is disposed between the two projections 36. This prevents the airplane from twisting during the launching procedure so that the nose of the plane is facing in the forward direction at the time of release.

Thus it can be seen that the launcher of the present invention has truly mets its stated objectives. The launcher provides a convenient method for employing centrifugal action in a hand-held launcher for launching a number of different types and kinds of small projectiles.

Wherefore, having thus described my invention, I claim:

1. A projectile launcher comprising:

(a) an elongated rigid member having a handle portion on one end adapted for gripping and an outward projection normal to the longitudinal axis of said member adjacent the opposite end thereof;

(b) a resiliently flexible flexible member connected to said rigid member adjacent said handle portion to one end to be disposed close adjacent and parallel to said rigid member, said flexible member covering and resting against the outer end of said projection on the other end to form a pocket adjacent said projection bounded by said projection, said flexible member, and said rigid member wherein a projectile can be placed; and, (c) a pair of second projections carried by said rigid member intermediate the ends thereof disposed with one on each side of said flexible member and facing generally in the same direction as said outward projection.

2. A projectile launcher comprising:

(a) an elongated rigid member having a handle portion on one end adapted for gripping and an outward projection normal to the longitudinal axis of said member adjacent the opposite end thereof; and, (b) a resiliently flexible member connected to said rigid member adjacent said handle portion on one end to be disposed close adjacent and parallel to said rigid member, said flexible member covering and resting against the outer end of said projection on the other end to form a pocket adjacent said projection bounded by said projection, said flexible member, and said rigid member wherein a projectile can be placed, said flexible member further including a bottom projection disposed toward said handle portion from said outward projection, of substantially the same length as said outward projection and facing said outward projection to form a bottom to said pocket.

3. A projectile launcher comprising:

(a) an elongated rigid member having a handle portion on one end adapted for gripping and an outward projection normal to the longitudinal axis of said member adjacent the opposite end thereof, said rigid member comprising an elongated rigid piece of material having an elongated first resiliently flexible piece of material connected thereto adjacent said handle portion and disposed parallel and close adjacent thereto, said first resiliently flexible piece of material including said outward projection; and, (b) a resiliently flexible member comprising a second resiliently flexible piece of material connected to said rigid member adjacent said handle portion on one end to be disposed close adjacent and parallel to said rigid member, said flexible member covering and resting against the outer end of said projection on the other end to form a pocket adjacent said projection bounded by said projection, said flexible member, and said rigid member wherein a projectile can be placed.

4. A projectile launcher comprising:

(a) an elongated rigid member having a handle portion on one end adapted for gripping and an outward projection normal to the longitudinal axis of said member adjacent the opposite end thereof;

(b) a resiliently flexible member connected to said rigid member adjacent said handle portion on one end to be disposed close adjacent and parallel to said rigid member, said flexible member covering and resting against the outer end of said projection on the other end to form a pocket adjacent said projection bounded by said projection, said flexible member, and said rigid member wherein a projectile can be placed; and, (c) means for holding said flexible member adjacent said rigid member at adjustable points between said pocket and said handle portion whereby the effective flexible length of said flexible member and thereby the force required to open said pocket to release a projectile are adjustable.

* * * * *

UNITED STATES PATENT AND TRADEMARK OFFICE

CERTIFICATE OF CORRECTION

PATENT NO. : 4,308,849
DATED : January 5, 1982
INVENTOR(S) : Daniel Seregely

It is certified that error appears in the above-identified patent and that said Letters Patent is hereby corrected as shown below:

The title page showing the illustrative figure should be deleted to appear as per attached page.

The Summary in column 1 should appear as shown on the attached page.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*

United States Patent [19]

Seregely

[11] 4,308,849

[45] Jan. 5, 1982

[54] PROJECTILE LAUNCHER

[76] Inventor: Daniel Seregely, P.O. Box 2021, Santa Monica, Calif. 90406

[21] Appl. No.: 148,702

[22] Filed: May 12, 1980

[51] Int. Cl.[3] ..... F41B 3/04

[52] U.S. Cl. ..... 124/5; 273/416; 46/81; 124/41 R

[58] Field of Search ..... 124/5, 41 R, 6, 7, 8, 124/79

[56] References Cited

U.S. PATENT DOCUMENTS

| | | | |
|---|---|---|---|
| 1,186,098 | 6/1916 | Horst | 124/5 |
| 3,373,730 | 3/1968 | Jenison | 124/5 |
| 3,901,208 | 8/1975 | Laporte et al. | 124/5 |

*Primary Examiner*—Richard C. Pinkham

*Assistant Examiner*—William R. Browne

*Attorney, Agent, or Firm*—Poms, Smith, Lande & Rose

[57] ABSTRACT

A projectile launcher for launching toy airplanes, darts, and the like. An elongated rigid member has a handle portion on one end and has a resiliently flexible member extending from the handle in close adjacent parallel relationship to the rigid member. At the end opposite the handle, the rigid member has a forward projection directed towards the flexibly resilient member to form a pocket between the two. The projectile or a weighted portion thereof is inserted within the pocket. When the launcher is swung by the handle, the pocket is maintained closed by the pushing force of the rigid member. Upon reaching the end of the launching stroke, the flexible member continues its motion by flexing to thereby open the pocket and release the projectile.

4 Claims, 12 Drawing Figures

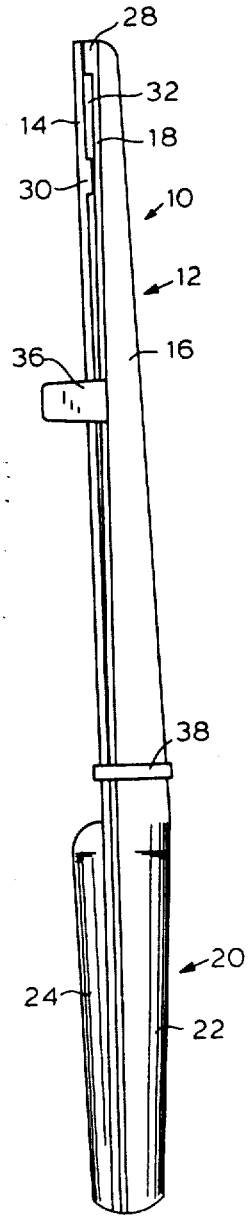

UNITED STATES PATENT AND TRADEMARK OFFICE

CERTIFICATE OF CORRECTION

PATENT NO. : 4,308,849

DATED : January 5, 1982

INVENTOR(S) : Daniel Seregely

It is certified that error appears in the above-identified patent and that said Letters Patent is hereby corrected as shown below:

SUMMARY

The foregoing objective has been met by the projectile launcher of the present invention comprising an elongated rigid member having a handle portion on one end adapted for gripping and an outward projection normal to the longitudinal axis of the member adjacent the opposite end thereof; and, a resiliently flexible member connected to the rigid member adjacent the handle portion on one end to be disposed close adjacent and parallel to the rigid member, said flexible member covering and resting against the outer end of the projection on the other end to form a pocket between the projection, the flexible member and the rigid member adjacent the projection wherein a projectile can be placed in the pocket and launched by rapidly swinging the launcher in the direction of the projection to a point of release wherein the swinging is terminated to, thereby, open the pocket and release the projectile.